US005836512A

United States Patent [19]

Briggs

[11] Patent Number: 5,836,512

[45] Date of Patent: Nov. 17, 1998

[54] UNITARY STEEL RAILROAD TIE

[75] Inventor: Alan Briggs, North Barrington, Ill.

[73] Assignee: Tie & Track Systems, Inc., Lemont, Ill.

[21] Appl. No.: 790,166

[22] Filed: Jan. 29, 1997

[51] Int. Cl.[6] ..... E01B 3/00

[52] U.S. Cl. ..... 238/60

[58] Field of Search ..... 238/59, 60, 61, 238/82, 56, 99, 89

[56] References Cited

U.S. PATENT DOCUMENTS

| | | | |
|---|---|---|---|
| 478,058 | 6/1892 | Hartford . | |
| 496,133 | 4/1893 | Ponsard . | |
| 609,123 | 8/1898 | Saathoff . | |
| 614,614 | 11/1898 | Hoon . | |
| 626,233 | 6/1899 | Hoon . | |
| 688,904 | 12/1901 | Vachon . | |
| 844,774 | 2/1907 | Bonzano . | |
| 905,624 | 12/1908 | Ambert | 238/60 |
| 1,034,389 | 7/1912 | Maas . | |
| 1,050,708 | 1/1913 | Yeadicke . | |
| 1,088,106 | 2/1914 | Slick . | |
| 1,089,309 | 3/1914 | Blose et al. . | |
| 1,194,240 | 8/1916 | Sandberg . | |
| 1,316,049 | 9/1919 | Levaire . | |
| 1,670,994 | 5/1928 | Snyder et al. . | |
| 1,770,251 | 7/1930 | Paff . | |
| 1,906,006 | 4/1933 | Harvey . | |
| 1,936,824 | 11/1933 | Buchholz | 238/59 |
| 1,969,062 | 8/1934 | Humain | 238/59 |
| 2,386,100 | 10/1945 | Ezell . | |
| 4,417,690 | 11/1983 | Langman . | |
| 4,728,030 | 3/1988 | Hodgson . | |

FOREIGN PATENT DOCUMENTS

| | | | |
|---|---|---|---|
| 489440 | 2/1919 | France . | |
| 761143 | 3/1934 | France . | |
| 284221 | 4/1932 | Italy . | |
| 14143 | 10/1888 | United Kingdom | 238/60 |

*Primary Examiner*—Mark T. Le
*Attorney, Agent, or Firm*—Anthony S. Zummer

[57] ABSTRACT

An improved unitary steel tie which is positionable in ballast of a railway track system includes an elongated channel body. The channel body includes an elongated web and a pair of sidewalls formed integral with opposite edges of the web. The channel body has a pair of opposed ends. An integral rail seat is adjacent to each of the opposed ends. Each rail seat is formed on the web and is adapted for connecting a rail to the web. An indentation is formed in each sidewall adjacent to each end of the body. The indentations at each end are opposed to each other forming a reduced section between the sidewalls at each end of the body to restrict movement of ballast toward the respective end and along the length of the body between the sidewalls. An apex is formed in the web above each reduced section and each apex is substantially the same height as the other apex. The apexes are the high points of the web. A flared spade is formed integral with each end of the body. Each of the spades extends downward from the web below the sidewalls.

20 Claims, 4 Drawing Sheets

UNITARY STEEL RAILROAD TIE

BACKGROUND OF THE INVENTION

A railroad track is made up of a pair of parallel rails which are held apart a consistent distance by railroad ties. The rails are secured to the ties by any one of a number of systems. One of the most common means of securing a rail to a tie is the utilization of railroad spikes in cooperation with a tie plate on a wood tie. The utilization of wood ties has been found to be ecologically unsuitable. Wood ties require the depletion of natural resources. In order to preserve the wood ties, the ties are treated with a substance, such as, a creosote, which is environmentally undesirable. As the wood ties become old and unable to perform satisfactorily, there is the environmental problem of getting rid of the spent wood ties.

Other materials are used for ties, such as, concrete and steel. The advantage of a steel tie is that once the steel tie has become worn and no longer useful, it may be recycled to make a new steel tie, unlike the wood or concrete ties.

Irrespective of the tie material, railroad ties are positioned in ballast which is chipped and compacted stone. The purpose of the ballast is to provide drainage for rain, snow and ice away from the rails and to transmit the loading of the train on the track to the ground below the ballast. One of the problems which has been observed with all ties, including steel ties, is that the ballast tends to move away from the tie during usage, so that the ballast is no longer effective in draining rain, snow and ice away from the rail and transmitting the load to the supporting ground. It is desirable to control movement of ballast under the tie and to increase the ability of the tie to resist lateral movement thereby improve track stability, reduce track bed maintenance and allow the track to carry larger axle loads at higher speeds.

SUMMARY OF THE INVENTION

The present invention is a unitary steel railroad tie which is positionable in ballast for use in a railway track system. The unitary tie includes an elongated channel body having a web and a pair of opposed sidewalls formed integral with opposite edges of the web. The channel body has a pair of longitudinally spaced opposed ends. An integral rail seat is positioned adjacent to each of the opposed ends of the channel body. Each rail seat is formed on the web and is adapted for receiving conventional equipment for securing a rail to the tie. An indentation is formed in each sidewall adjacent to each end of the channel body. The indentations at each end are diametrically opposed to each other forming a reduced section between the sidewalls at each end of the body. The opposed indentations create an apex in the web which is a high portion of the web, so that the web slopes downward from each apex toward the longitudinal center of the channel body. The slope of the web upward from the center cants the rail seats toward each other so that rails mounted on the rail seats are in a like manner canted toward each other. The reduced section between the sidewalls at each end of the body restricts movement of ballast toward the respective end and along the length of the body between the sidewalls to retain the ballast. A flared spade is formed integral with each end of the body and extends downward below the sidewalls for the retention of ballast at the respective end of the tie.

Detailed DESCRIPTION OF THE PREFERRED EMBODIMENT

Figures 1, 2, 3:
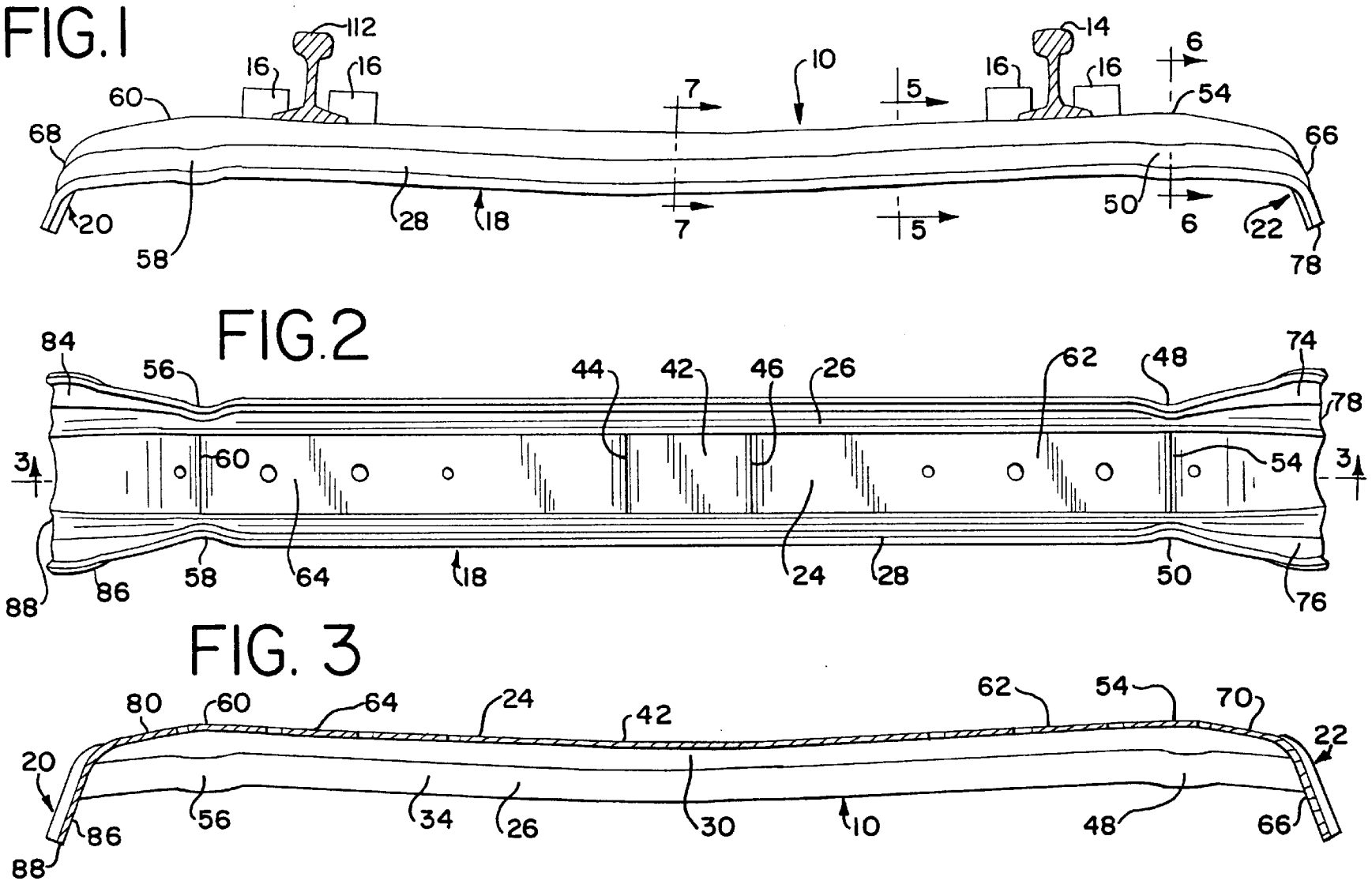
FIG. 1 is a side elevational view of a unitary steel railroad tie embodying the present invention with a pair of rails mounted thereon.
FIG. 2 is a top plan view of the railroad tie shown in FIG. 1, but with the rails removed.
FIG. 3 is a cross sectional view of the railroad tie shown in FIG. 2 taken on Line 3—3 of FIG. 2.
Figure 4:
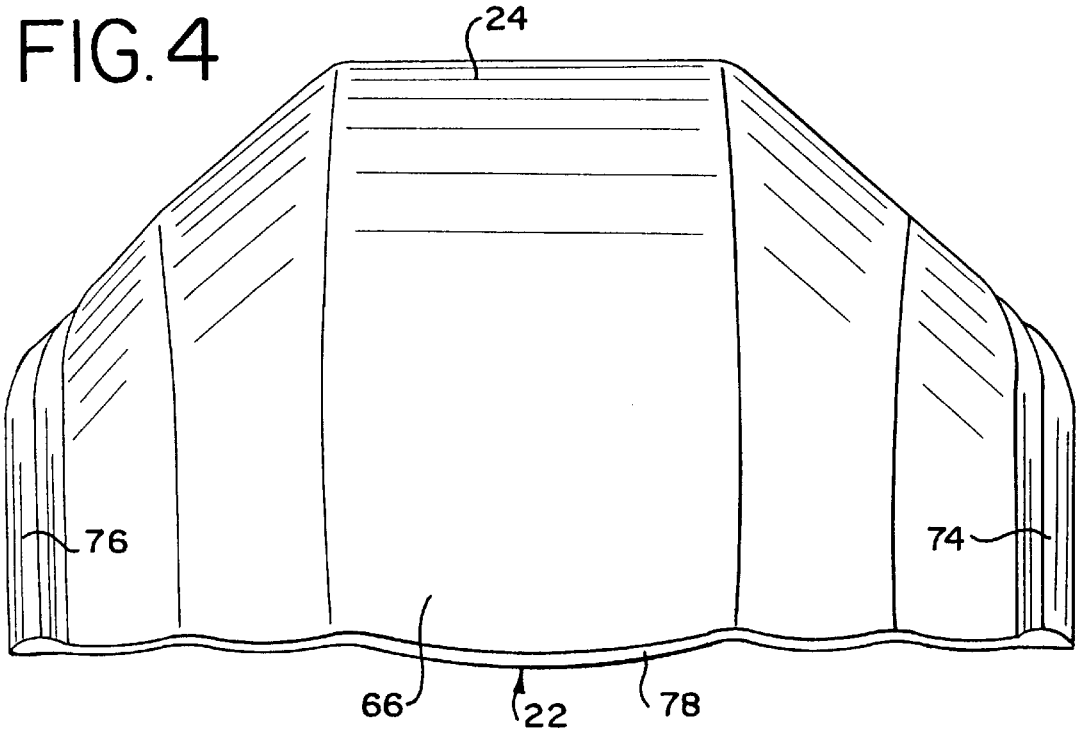
FIG. 4 is an end view of the railroad tie of FIG. 2.

Referring now to the drawings, and especially to FIG. 1, a unitary steel railroad tie (also known as a "sleeper") embodying the present invention is shown therein and is generally indicated by numeral 10. A pair of conventional rails 12 and 14 is shown mounted on the tie 10 and held thereon by conventional and well known rail clips 16.

Figure 7:
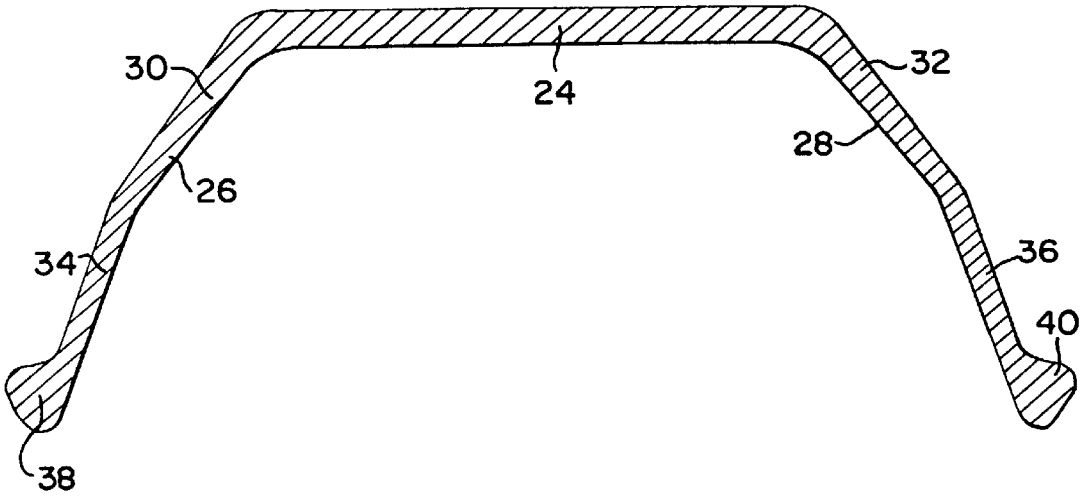
FIG. 7 is a cross sectional view of the railroad tie of FIG. 1 taken on Line 7—7 of FIG. 1.

Tie 10 generally includes a channel body 18 with a pair of identical ends 20 and 22 formed on longitudinally opposite ends of the channel body. The channel body generally includes a web 24 which extends the length of the body to ends 20 and 22. The web has a pair of opposed edges with sidewalls 26 and 28 formed integral with the edges. As may be best seen in FIG. 7, sidewalls 26 and 28 have inner strips 30 and 32, respectively, formed integral with the opposed edges of web 24. The sidewalls 26 and 28 each have outer strips 34 and 36, formed integral with inner strips 30 and 32, respectively. The outer strips 34 and 36 have reinforcing beads 38 and 40, respectively, formed integral with the free or outer edges of respective outer strips.

Figure 5:
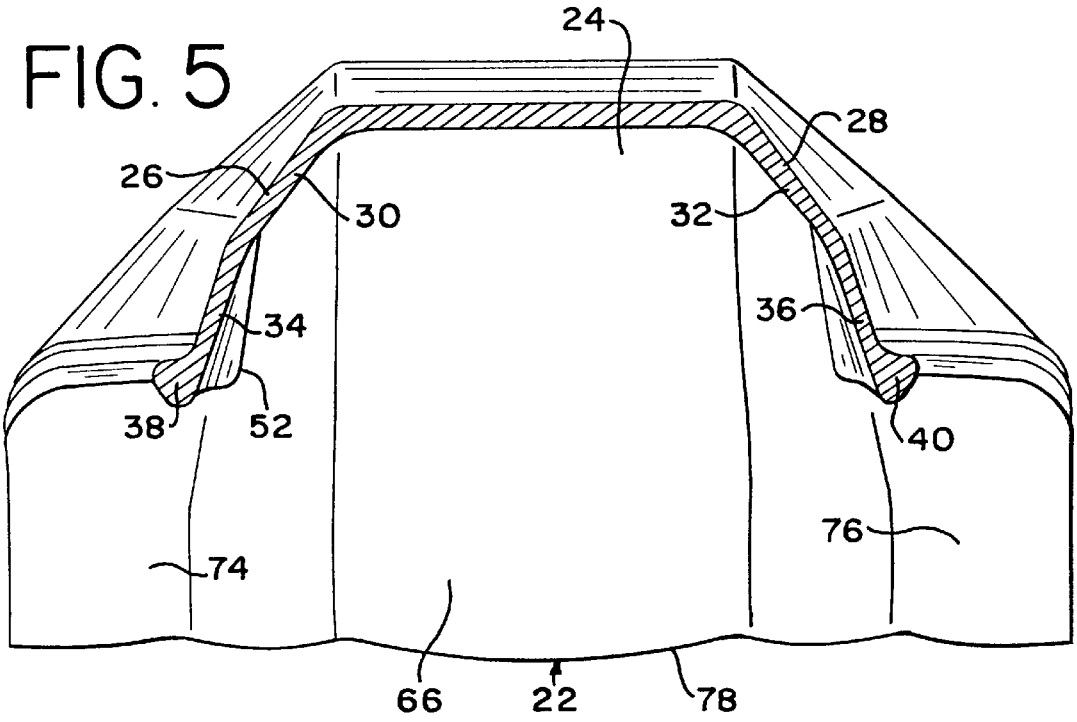
FIG. 5 is a cross sectional view of the railroad tie of FIG. 1 taken on Line 5—5 of FIG. 1.
Figure 6:
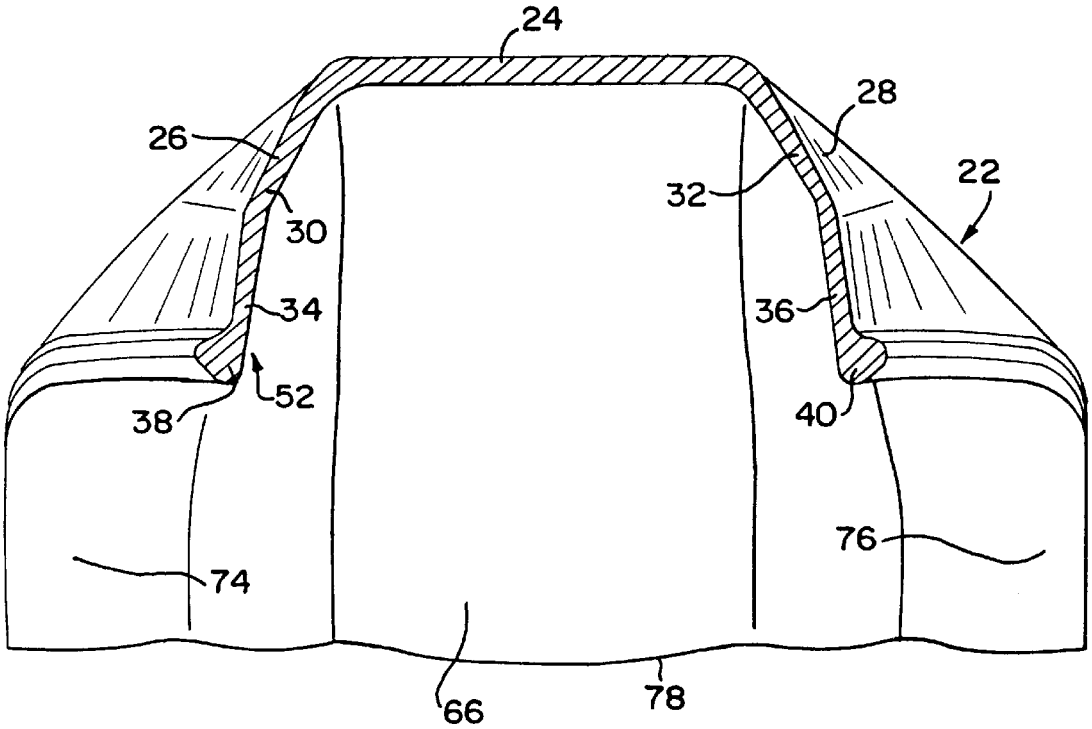
FIG. 6 is a cross sectional view of the railroad tie of FIG. 1 taken on Line 6—6 of FIG. 1.

Web 24 has a central flat section 42 in the longitudinal center of the channel body. The flat section 42 has edges 44 and 46 adjacent to ends 20 and 22, respectively. Indentations 48 and 50 are formed in sidewalls 26 and 28, respectively, adjacent to end 22. The indentations form an interior reduced section 52 in the channel body, as may be seen in FIG. 5. An apex 54 is formed at the reduced section so that web 24 slopes downward from apex 54 to edge 46 of the flat section. In a like manner, indentations 56 and 58 are formed in sidewalls 26 and 28, respectively, adjacent to end 20 to produce an interior reduced section of the channel body adjacent to end 20. The interior reduced section adjacent to end 20, not shown in the drawing, is like interior reduced section 52 adjacent to end 22. An apex 60 is formed at the reduced section formed by indentations 56 and 80. In this instance, all of the indentations are 2.54 centimeters (1 inch) deep, though different depths may be used for specific applications. Web 24 slopes downward from apex 60 to edge 44 of flat portion 42 of the web. Apex 54 and apex 60 are of equal height and define the high points of the tie, as may be seen in FIGS. 1 and 3. A rail seat 62 is provided adjacent to end 22 and a rail seat 64 is provided adjacent to end 20. The aforementioned rails 12 and 14 are mounted on the rail seats 64 and 62, respectively, in a conventional and well know manner. Rail seats 62 and 64 follow the slope of the respective portions of the web, so that the seats are canted toward each other. In this instant, the cant angle is 1.42°, though the cant angle may be as much as 2.90°. Since the rails are mounted on the canted rail seats, the rails are canted the same amount as the respective rail seats.

A flared spade 66 is integrally formed on end 22. In a like manner, a like flared spade 68 is integrally formed on end 20. The flared spades have web 24 extending through their respective central portions. A reverse angle shoulder 70 extends from apex 54 to flared spade 66. The angle α of the shoulder to the horizontal is 10°, though it may be as little as 1°, or as great as 15°. Spade 66 has a face 72 which is at an angle to the vertical identified as angle β and is at 20°; however, the angle may be between 10° and 25° depending upon the specific application, so that the flared spade 66 has an angle with the web in the reverse angle shoulder greater than 90°. Spade 66 has the sidewalls 26 and 28 flared out into wings 74 and 76, respectively. Wings 74 or 76 have their outermost edges extending toward the indentations 48 and 50, respectively. Flared spade 66 has its lower edge 78 extending below sidewalls 26 and 28, as may be seen in FIGS. 1 and 3. The wings in cooperation with the spade retain the ballast at the end of the tie.

In like manner to flared spade 66, flared spade 68 is connected to reverse angle shoulder 80, which has the same angle to be horizontal as shoulder 70. Spade 68 includes a face 82, which is at an angle to the vertical the same amount as face 72. Spade 68 has wings 84 and 86, which are mirror images of wings 74 and 76, respectively. Spade 68 has a lower edge 88 below the sidewalls 26 and 28, the same distance as edge 78. Wings 84 and 86 cooperate with spade 68 to retain the ballast at the respective end of the tie.

Figure 8:
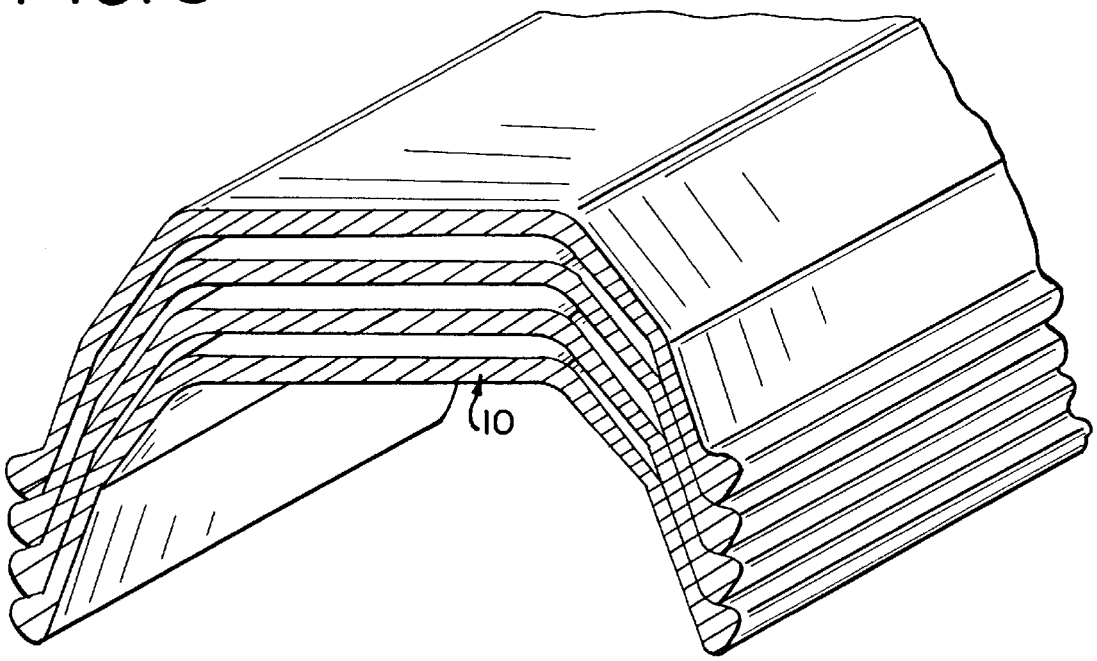
FIG. 8 is an enlarged fragmentary cross sectional perspective view showing a plurality of railroad ties constructed in accordance with the railroad tie of FIG. 1 showing the railroad ties stacked on top of each other.
Figure 9:
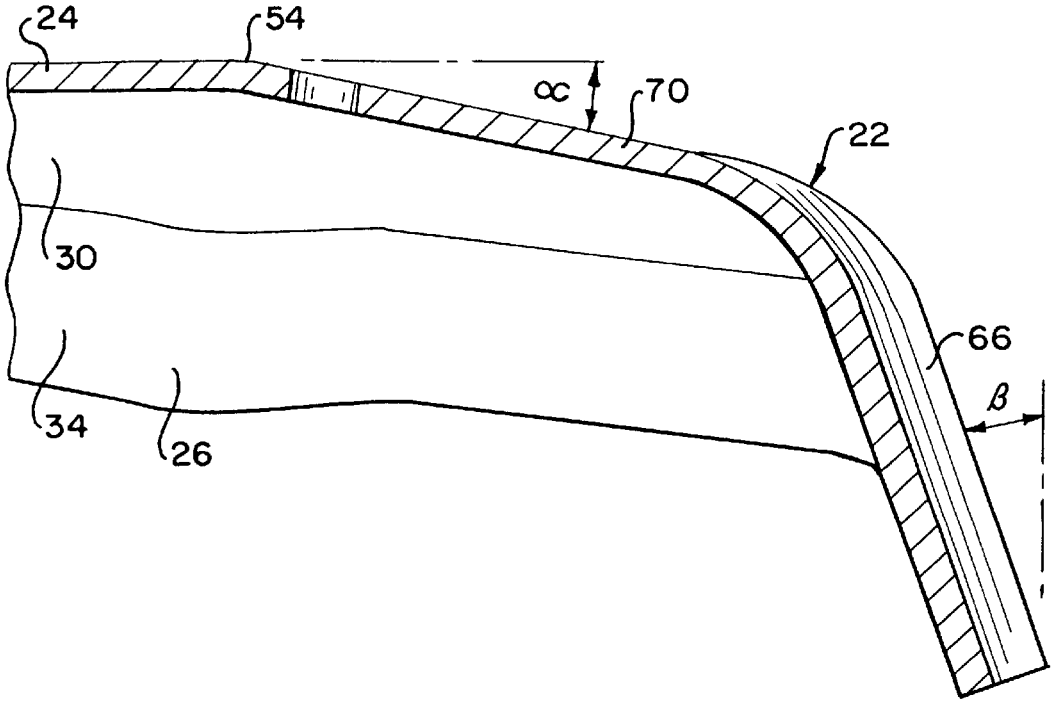
FIG. 9 is an enlarged view of the right end of the cross sectional view of FIG. 3 showing the relative position of various parts of the end of the tie.

As may be seen in FIG. 8, tie 10 may be stacked with other like ties for ease of storage and transportation.

Tie 10 is employed in a railway track system by positioning the tie in a selected location and attaching rails 12 and 14 to the tie. Ballast which is used in the track system is contained within the body and outside of the body and the ends of the tie. When the tie is in position, the ballast is compacted around the tie.

In usage, vibration of the tie resulting from trains passing over the tie causes the ballast to vibrate and tend to move. However, the ballast is contained within the tie by the interior reduced sections of the channel body at opposite ends thereof. Thus, the tie is always supported on the ballast. The flared spades with the outermost edges of the wings direct the ballast inward at the ends and assist in containing the ballast under the tie. The ballast at the end of the tie is prevented from moving away from the tie. The ballast remains in contact with the tie so that the ballast is operative in supporting the tie and to allow rain, snow and ice to drain from the rails.

Although a specific embodiment of the herein disclosed invention has been shown and described in detail above, it is readily apparent that those skilled in the art may make various modifications and changes without departing from the spirit and scope of the present invention. It is to be expressly understood that the scope of this invention is limited only by the appended claims.

What is claimed is:

1. A unitary steel railroad tie positionable in ballast for use in a railway track system comprising: an elongated channel body having a web and a pair of sidewalls formed integral with opposite edges of the web, said channel body having a pair of opposed ends, an integral rail seat adjacent to each of the opposed ends of said channel body, each rail seat being formed on the web and being adapted for connecting a rail to the web, an indentation in each sidewall adjacent to each end of the body, the indentations at each end being opposed to each other forming an interior reduced section between the sidewalls at each end of the body to restrict movement of ballast toward the respective end along the length of the body between the sidewalls, an apex in the web and directly above each interior reduced section, each apex being substantially the same height as the other apex and being the high points of the web, and a flared spade formed integral with each end of the body, each of said spades extending downward from the web below the sidewalls.

2. A uinitary steel railroad tie positionable in ballast for use in a railway track system as defined in claim 1, wherein said web is canted downward toward the longitudinal center of the channel body from each apex above the respective interior reduced section.

3. A unitary steel railroad tie positionable in ballast for use in a railway track system as defined in claim 1, wherein each flared spade extends downward at an angle greater than 90° with the respective portion of the web extending from the respective adjacent apex to the spade.

4. A unitary steel railroad tie positionable in ballast for use in a railway track system as defined in claim 1, wherein each of said flared spades has its respective outer edges extending into the respective sidewalls of the channel body toward the respective adjacent interior reduced section.

5. A unitary steel railroad tie position able in ballast for use in a railway track system as defined in claim 1, wherein each interior reduced section is positioned between its adjacent respective spade and the adjacent respective rail seat.

6. A unitary steel railroad tie positionable in ballast for use in a railway track system as defined in claim 1, wherein the web has a flat section at the longitudinal center of the tie, and the web extends upward from each end of the flat section toward the respective apex.

7. A unitary steel railroad tie positionable in ballast for use in a railway track system as defined in claim 1, wherein each sidewall has a reinforcing bead formed integral with its free edge.

8. A unitary steel railroad tie positionable in ballast for use in a railway track system as defined in claim 1, wherein each flared spade extends downward at an angle greater than 90° with the respective portion of the web extending from the respective apex to the spade, said web is canted downward from each apex toward the longitudinal center of the channel body.

9. A unitary steel railroad tie positionable in ballast for use in a railway track system as defined in claim 1, wherein said web slopes downward from each apex toward the longitudinal center of the channel body, each of said flared spades has its respective outer edges extending toward the respective sidewalls of the channel body at the respective adjacent interior reduced section.

10. A unitary steel railroad tie positionable in ballast for use in a railway track system as defined in claim 1, wherein each interior reduced section is positioned between its adjacent respective spade and the adjacent rail seat, said web is canted downward from each apex toward the longitudinal center of the channel body to cant each of the rail seats.

11. A unitary steel railroad tie positionable in ballast for use in a railway track system as defined in claim 1, wherein the web has a flat section at the longitudinal center of the channel body, said web is canted downward from each apex toward the flat section.

12. A unitary steel railroad tie positionable in ballast for use in a railway track system as defined in claim 1, wherein said web is canted downward from each apex toward the longitudinal center of the channel body, each sidewall has a reinforcing bead formed integral with its free edge.

13. A unitary steel railroad tie positionable in ballast for use in a railway track system as defined in claim 1, wherein each flared spade extends downward at an angle greater than 90° with the respective portion of the web extending from the respective apex to the spade, each of said flared spades has its respective outer edges extending into the respective sidewalls of the channel body toward the respective adjacent interior reduced section.

14. A unitary steel railroad tie positionable in ballast for use in a railway track system as defined in claim 1, wherein each reduced section is positioned between its adjacent respective spade and the adjacent rail seat, each flared spade extends downward at an angle greater than 90° with the respective section of the web extending from the respective apex to the spade.

15. A unitary steel railroad tie positionable in ballast for use in a railway track system as defined in claim 1, wherein each flared spade extends downward at an angle greater than 90° with the respective portion of the web extending from the respective apex to the spade, said web has a flat section having opposed ends at the longitudinal center of the channel body, and the web extends downward from each apex toward the respective end of the flat section.

16. A unitary steel railroad tie positionable in ballast for use in a railway track system as defined in claim 1, wherein each flared spade extends downward at an angle greater than 90° with the respective portion of the web extending from the respective apex to the spade, and each sidewall has a reinforcing bead formed integral with its free edge.

17. A unitary steel railroad tie positionable in ballast for use in a railway track system as defined in claim 1, wherein each interior reduced section is positioned between its adjacent respective spade and the adjacent rail seat, said web has a flat section at the longitudinal center of the channel body and the web extends downward from each apex to the flat section to cant the rail seats toward each other, and each sidewall has a reinforcing bead formed integral with its free edge.

18. A unitary steel railroad tie position able in ballast for use in a railway track system as defined in claim 1, wherein each interior reduced section and respective apex is positioned between its adjacent respective spade and the adjacent rail seat, each flared spade extends downward at an angle greater than 90° with the respective portion of the web extending from the respective apex to the spade, and each sidewall has a reinforcing bead formed integral with its free edge.

19. A unitary steel railroad tie positionable in ballast for use in a railway track system as defined in claim 1, wherein each interior reduced section is positioned between its adjacent respective spade and the adjacent rail seat, said web has a flat section at the longitudinal center of the tie and the web extends upward from opposed ends of the flat section toward the respective apex canting the rail seats toward each other, each spade extends downward at an angle greater than 90° with the respective portion of the web extending from the respective apex to the spade, and each sidewall has a reinforcing bead formed integral with its free edge.

20. A unitary steel railroad tie positionable in ballast for use in a railway track system as defined in claim 1, wherein each interior reduced section is positioned between its adjacent respective spade and the adjacent rail seat, said web has a flat section at the longitudinal center of the tie, the web extends upward from opposed ends of the flat section toward the respective apex to cant the rail seats toward each other, each flared spade extends downward at an angle greater than 90° with the respective portion of the web extending from the apex to the spade, each of said flared spades has its respective outer edges extending into the respective sidewalls of the channel body toward the respective adjacent reduced sections, and each sidewall has a reinforcing bead formed integral with its free edge.

* * * * *